US005394711A

United States Patent [19]

Pitkänen

[11] Patent Number: 5,394,711

[45] Date of Patent: Mar. 7, 1995

[54] PADLOCK WITH REMOVABLE COVER

[75] Inventor: Jukka Pitkänen, Joensuu, Finland

[73] Assignee: Abloy Security Ltd Oy, Helsinki, Finland

[21] Appl. No.: 153,658

[22] Filed: Nov. 16, 1993

[30] Foreign Application Priority Data

Feb. 9, 1993 [FI] Finland ..... 930069

[51] Int. Cl.[6] ..... E05B 67/02

[52] U.S. Cl. ..... 70/38 A; 70/51; 70/52; 70/368; 70/371; 70/DIG. 57

[58] Field of Search ..... 70/38 A, 51, 52, 371, 70/367-369, DIG. 57

[56] References Cited

U.S. PATENT DOCUMENTS

| | | | |
|---|---|---|---|
| 1,968,555 | 7/1934 | Horne | 70/367 |
| 1,990,794 | 2/1935 | McCormac | 70/368 |
| 2,430,391 | 11/1947 | Dequick | 70/368 |
| 2,557,028 | 6/1951 | Deutsch | 70/369 |
| 3,172,279 | 3/1965 | Patriquin | 70/38 A |
| 3,499,301 | 3/1970 | Niilola et al. | 70/52 |
| 3,835,675 | 9/1974 | Lippisch | 70/52 X |
| 3,882,699 | 5/1975 | Flack et al. | 70/368 X |
| 4,419,873 | 12/1983 | Sopko | 70/38 A |
| 4,545,223 | 10/1985 | Poutiainen et al. | 70/38 A |
| 4,836,001 | 6/1989 | Foshee | 70/368 |

FOREIGN PATENT DOCUMENTS

| | | | |
|---|---|---|---|
| 637180 | 4/1928 | France | 70/230 |

*Primary Examiner*—Lloyd A. Gall
*Attorney, Agent, or Firm*—Smith-Hill and Bedell

[57] ABSTRACT

A padlock includes a lock body (1) and a substantially U-shaped shackle (2), a lock mechanism (4) fitted into a cavity (3) in the lock body and to which at least one lock bolt (5) is functionally connected for locking the shackle to the lock body (1), a cover element (6), which is turnably connected to the lock body (1), preferably by means of threads, and which is located in the insertion direction of the key in front of the lock mechanism (4), and a stop member (7), arranged in the lock body transversally with regard to the cover element (6), removable in the open position of the shackle (2) and preventing, in its blocking position, turning of the cover element (6) with regard to the lock body (1), and a locking ring (10) placed in a groove (9) in the lock body (1) surrounding the cover element and arranged to be installed in its position in case the cover element (6) is to be locked permanently to the lock body (1).

15 Claims, 3 Drawing Sheets

PADLOCK WITH REMOVABLE COVER

BACKGROUND OF THE INVENTION

The invention relates to a padlock, including a lock body and in it a substantially U-shaped shackle, a lock mechanism fitted into a cavity in the lock body, preferably a cylinder lock with turnable locking discs, to which at least one lock bolt is functionally connected for locking an end of the shackle to the lock body, a cover element, which is turnably connected to the lock body, preferably by means of threads, and arranged in the insertion direction of the key in front of the lock mechanism, and blocking means for fastening the cover element to the lock body.

Different versions of padlocks are produced for different purposes, among others depending on whether the padlock is to be provided with a possibility for changing the lock mechanism or at least the opening combination thereof if necessary. For this possibility it is known to provide padlocks with a cover element to be placed in front of the lock mechanism and to be removably fastened to the lock body. The cover element can then be removed after first opening the lock mechanism and moving the shackle in its releasing or open position.

In case there is no need to provide the padlock with the changing possibility referred above, a locking ring, for example, known as such can be used as a fastening arrangement as well. From the view point of production and in order to reduce stock items, on the other hand, it would be of advantage to keep different versions of padlocks to a minimum.

An aim of the invention is to provide such a padlock of general kind that is favorable from the view point of production and that can still be easily modified for different purposes according to need so that the mentioned possibility of changing the lock mechanism or the opening combination thereof is especially taken account of.

SUMMARY OF THE INVENTION

The aim of the invention is achieved by employing as the said blocking means a stop member, transversal with regard to the cover element, removable in the open position of the shackle and preventing, in its blocking position, turning of the cover element with regard to the lock body, and a locking ring placed in a groove in the lock body surrounding the cover element and arranged to be installed in its position in case the cover element is locked permanently to the lock body.

In this way it is sufficient to have only one padlock construction, whereby the possibility of changing the lock mechanism can be arranged in accordance to whether or not a locking ring is installed in the lock. When a locking ring is employed the lock mechanism cannot be changed. In this case it is possible to leave the stop member completely out when desired. The stop member can still be used with advantage in all versions, because then it offers, together with the locking ring, a double protection against attempts to break up the cover element. In case the locking ring is not installed the cover element can be turned from its place and the lock mechanism changed after the shackle is first opened and the stop member is moved to a non-locking position.

In practice the cover element to be utilized includes at least one recess for partly receiving the stop member at the blocking position thereof and a groove for partly receiving the locking ring. The groove is preferably located in the insertion direction of the key in front of the said at least one recess.

The cover element can with advantage include also several recesses, preferably four recesses arranged at 90° intervals around the cover element. This makes it easier to install the stop member at its blocking position to be partly located in one of said recesses.

BRIEF DESCRIPTION OF THE DRAWINGS

In the following the invention will be described more in detail with reference to the attached drawing, in which.

DETAILED DESCRIPTION

Figure 1:
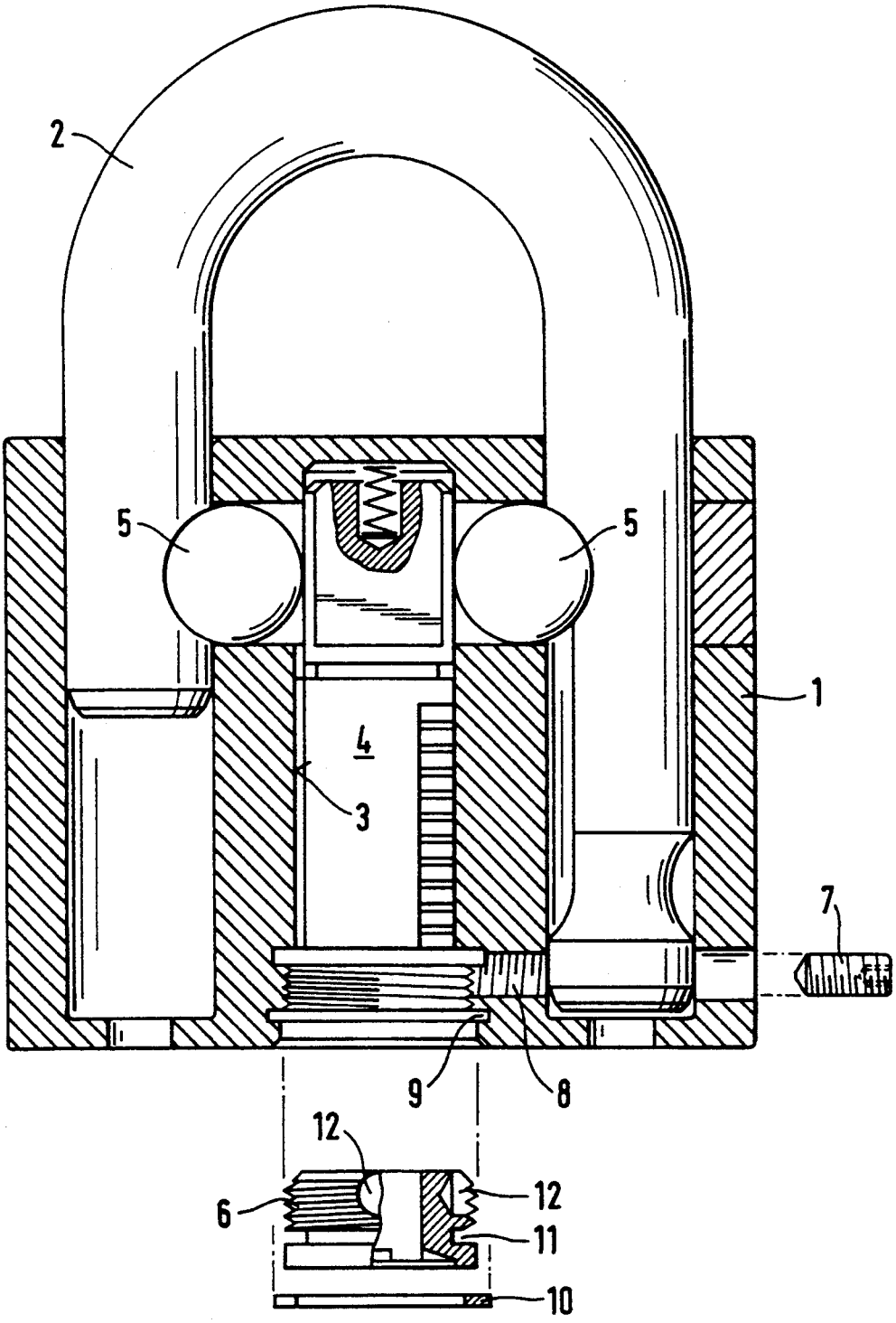
FIG. 1 shows a padlock according to the invention from the side, as a section and with the blocking means and the cover element removed.

In the drawing 1 indicates a lock body of the padlock, which is provided with a substantially U-shaped shackle 2. The lock body 1 includes a cavity 3 enclosing a lock mechanism 4, which is preferably a cylinder lock provided with turnable locking discs 4A, the opening combination of which is easily changeable when necessary. Functionally connected to the lock mechanism 4 there are lock bolts 5, by means of which both ends of the shackle 2 can be locked into the lock body 1.

The cavity 3 of the lock body is provided with a cover element 6, which is preferably by means of threads supported to the lock body 1 and arranged in front of the lock mechanism 4 in the insertion direction of the key, as well as blocking means for fastening the cover element 6 to the lock body 1. The blocking means comprise firstly a stop member 7, which is transversal with regard to the cover element 6 and removable in the open position of the shackle 2. The stop member 7 is located in a bore 8 and is preferably with threads supported to the lock body 1. In its closed position the stop member 7 extends to some degree into a recess 12 made in the cover element 6 and thereby prevents turning of the cover element 6 with regard to the lock body 1. The cover element 6 is preferably provided with several recesses 12 so as to make it more easy to get the stop member 7 engaged with the cover element 6.

Figure 2:
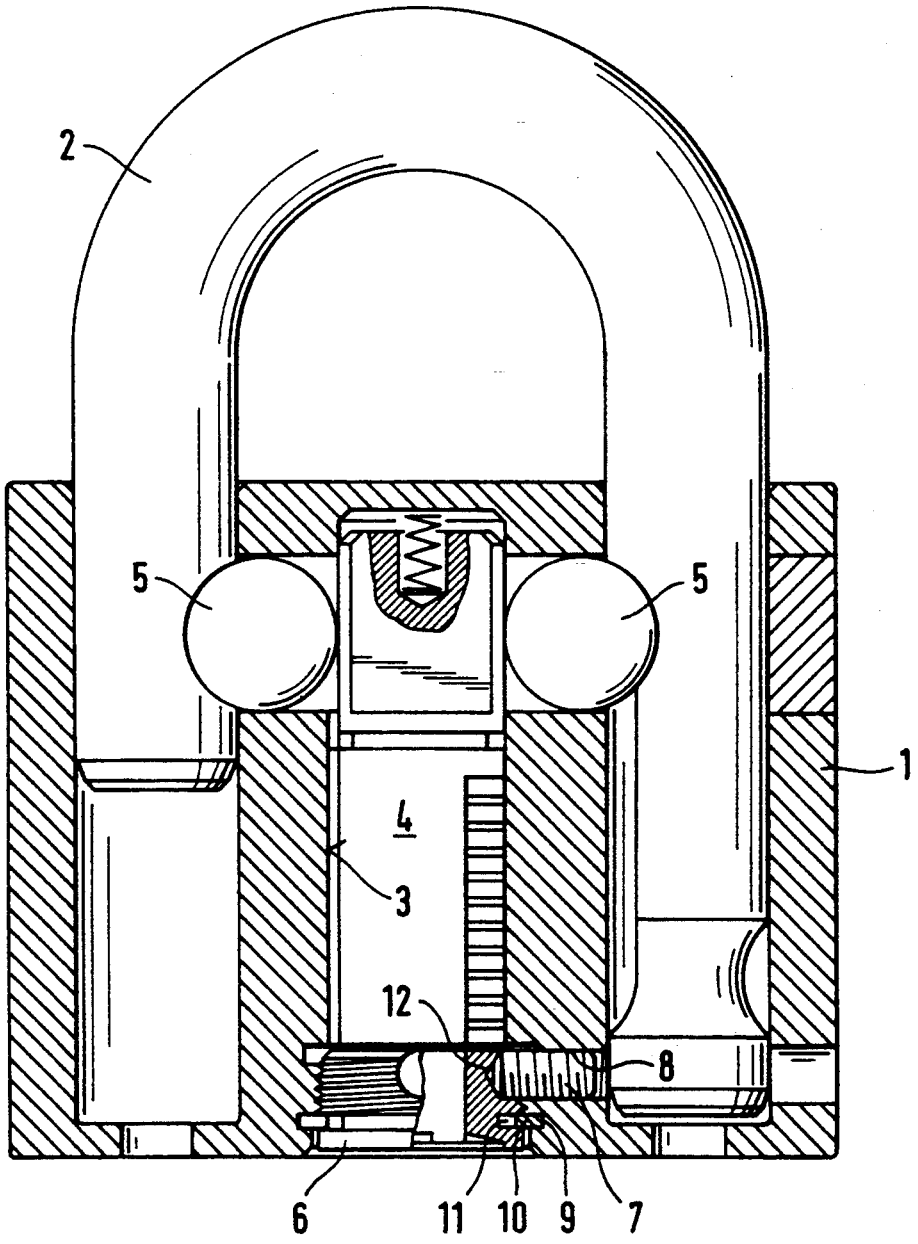
FIG. 2 shows the padlock of FIG. 1 in an assembled version, in which the lock mechanism is not changeable.

The lock body 1 is further provided with a groove 9 surrounding the cover element 6 and the cover element 6 is provided with a groove 11 respectively for installation of a locking ring 10 in case the cover element 6 is desired to be locked to the lock body 1 permanently. A padlock version of this kind is shown in FIG. 2 and it includes both the cover element 6, the stop member 7 and the locking ring 10 installed in place.

Figure 3:
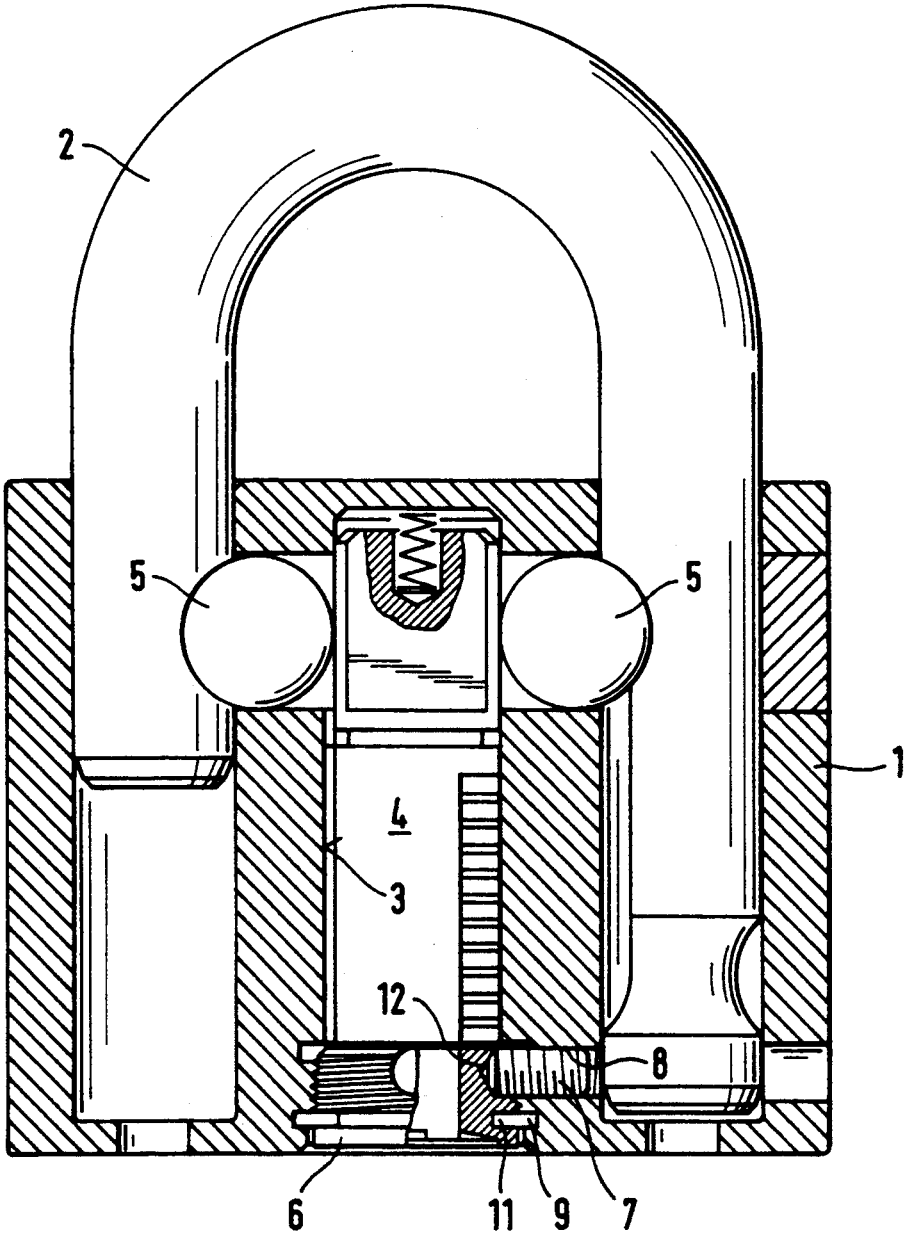
FIG. 3 shows the padlock of FIG. 1 in an assembled version, in which the lock mechanism is changeable respectively.

In FIG. 3, on the other hand, the cover element 6 and the stop member 7 are installed, but the locking ring 10 has been left out. Thus, after opening of the shackle 2 and turning of the stop member 7 sufficiently away from the cover element 6, the cover element 6 can removed from its place by turning and the lock mechanism 4 or the opening combination thereof can be changed. In this case, however, the locking ring 10 can also later be positioned in its place according to need.

The invention is not restricted to the embodiments shown, but several modifications are feasible within the scope of the attached claims.

I claim:

1. A padlock comprising:

a lock body formed with a cavity, a substantially U-shaped shackle fitted to the lock body and movable between a locking position and an open position, a lock mechanism fitted in the lock cavity, at least one lock bolt functionally connected to the lock mechanism for locking the shackle in its locking position, a cover element turnably connected to the lock body and located in front of the lock mechanism in an insertion direction of a key, the cover element being formed with at least one recess, and a stop member arranged in the lock body transversely with respect to the cover element for fastening the cover element to the lock body, the stop member being removable when the shackle is in the open position and having a blocking position in which it is partly received in the at least one recess in the cover element and prevents turning of the cover element relative to the lock body, and wherein the lock body is formed with a first groove and the cover element is formed with a second groove for each partly receiving a locking ring for preventing removal of the cover element.

2. A padlock according to claim 1, wherein the cover element is in threaded engagement with the lock body.

3. A padlock according to claim 1, wherein the cover element is formed with a plurality of angularly spaced recesses.

4. A padlock according to claim 3, wherein the cover element is formed with four recesses arranged at 90° intervals around the cover element.

5. A padlock according to claim 1, wherein the lock mechanism is a cylinder lock mechanism with turnable locking discs.

6. A padlock according to claim 1, wherein the second groove is located in front of the recess in the insertion direction of a key.

7. A padlock comprising:

a lock body formed with a cavity and with a first groove, a substantially U-shaped shackle fitted to the lock body and movable between a locking position and an open position, a lock mechanism fitted in the lock cavity, at least one lock bolt functionally connected to the lock mechanism for locking the shackle in its locking position, a cover element turnably connected to the lock body and located in front of the lock mechanism in an insertion direction of a key, the cover element being formed with at least one recess and with a second groove, a stop member arranged in the lock body transversely with respect to the cover element for fastening the cover element to the lock body, the stop member being removable when the shackle is in the open position and having a blocking position in which it is partly received in the at least one recess in the cover element and prevents turning of the cover element relative to the lock body, and a locking ring partly received in the first groove and partly received in the second groove for preventing removal of the cover element.

8. A padlock according to claim 7, wherein the cover element is in threaded engagement with the lock body.

9. A padlock according to claim 7, wherein the cover element is formed with a plurality of angularly spaced recesses.

10. A padlock according to claim 9, wherein the cover element is formed with four recesses arranged at 90° intervals around the cover element.

11. A padlock according to claim 7, wherein the lock mechanism is a cylinder lock mechanism with turnable locking discs.

12. A padlock according to claim 7, wherein the second groove is located in front of the at least one recess in the insertion direction of a key.

13. A method of modifying a padlock that comprises a lock body formed with a cavity and a first groove, a substantially U-shaped shackle fitted to the lock body and movable between a locking position and an open position, a lock mechanism fitted in the lock cavity, at least one lock bolt functionally connected to the lock mechanism for locking the shackle in its locking position, a cover element turnably connected to the lock body and located in front of the lock mechanism in an insertion direction of a key and formed with a second groove, and a stop member arranged in the lock body in a blocking position in which it engages the cover element and prevents turning of the cover element relative to the lock body, the stop member being disengageble from the cover element when the shackle is in the open position to allow turning of the cover element, said method comprising placing the shackle in its open position, disengaging the stop member from the cover element, removing the cover element from the lock body, and reinstalling the cover element in the lock body with a locking ring fitted partly in the first groove and partly in the second groove for preventing subsequent removal of the cover element.

14. A method according to claim 13, wherein the step of disengaging the stop member from the cover element comprises removing the stop member from the lock body, and the method comprises reinstalling the cover element without replacing the stop member in the lock body.

15. A method according to claim 13, wherein the step of disengaging the stop member from the cover element comprises removing the stop member from the lock body, and the method further comprises replacing the stop member in the lock body.

* * * * *